US005904785A

United States Patent [19]

Aizawa et al.

[11] Patent Number: 5,904,785

[45] Date of Patent: May 18, 1999

[54] PROCESS FOR FORMING A PHOSPHATE CONVERSION COATING

[75] Inventors: Kenji Aizawa; Yutaka Okabayashi, both of Kanagawa-Ken, Japan

[73] Assignee: Henkel Corporation, Gulph Mills, Pa.

[21] Appl. No.: 08/765,934

[22] PCT Filed: Jul. 11, 1995

[86] PCT No.: PCT/US95/08228

§ 371 Date: Feb. 11, 1997

§ 102(e) Date: Feb. 11, 1997

[87] PCT Pub. No.: WO96/01914

PCT Pub. Date: Jan. 25, 1996

[30] Foreign Application Priority Data

Jul. 12, 1994 [JP] Japan ..... 6-159901

[51] Int. Cl.[6] ..... C23C 22/36

[52] U.S. Cl. ..... 148/259; 148/251; 148/243

[58] Field of Search ..... 148/251, 243, 148/259, 260; 210/712, 714

[56] References Cited

FOREIGN PATENT DOCUMENTS 0434358 6/1991 European Pat. Off. .

53-109871 9/1978 Japan .

56-105485 8/1981 Japan .

57-70281 4/1982 Japan .

60-204889 10/1985 Japan .

OTHER PUBLICATIONS

*Dai–39–kai Fushoku Boshoku Toronkai Gaiyo* (Proceedings of the 39th Japan Corrosion Conference) in Foshoku Boshoku Kyokai–shi (Corrosion Engineering) Dec. 1991.

*Primary Examiner*—Scott Kastler

*Attorney, Agent, or Firm*—Wayne C. Jaeschke; Norvell E. Wisdom, Jr.; Frank E. Robbins

[57] ABSTRACT

To prevent the deterioration in water-resistant secondary adherence that occurs during prolonged use of a fluoride-containing phosphate conversion coating liquid composition to form a conversion coating on metal surfaces that are at least partly aluminiferous, the aluminum compound-containing sludge produced in the phosphate conversion coating liquid composition as it is used is coagulated and sedimented by adding at least one cationic polymeric coagulant to the sludge-containing phosphate conversion coating liquid composition.

20 Claims, No Drawings

PROCESS FOR FORMING A PHOSPHATE CONVERSION COATING

BACKGROUND OF THE INVENTION

1. Field of the Invention

This invention relates to a method for forming a phosphate conversion coating on metal surfaces that include at least some aluminiferous metal surfaces, which for the purposes of the present invention are to be understood as those containing at least 0.5% of aluminum in their surfaces, are generally exemplified by aluminum sheet, steel sheet plated with Zn-Al alloy, aluminum-plated steel sheet, and the like, and are found, for example, on automotive outer body sheet, on colored sheet-metal roofing material, and so forth.

1. Statement of Related Art

Phosphate conversion coating of metals forms on the metal surface a coating, with a chemical composition typified by $Zn_3(PO_4)_2 \cdot n\ H_2O$, $Zn_2Fe(PO_4)_2 \cdot n\ H_2O$, and/or $Zn_2Ca(PO_4)_2 \cdot n\ H_2O$ for the example of zinc phosphate treatments. This is brought about by contacting the metal surface, usually is by spraying or dipping, with a phosphate liquid conversion coating composition in order to dissolve the surface of the metal. Phosphate conversion coatings improve the metal's resistance to rusting and its paint adherence.

Zinc phosphate liquid conversion coating compositions contain phosphoric acid, $Zn^{2+}$ ions, and water as their essential components and may contain, for example, $Ni^{2+}$, $Mn^{2+}$, $Ca^{2+}$, $Fe^{2+}$, $H^+$, $Na^+$, $K^+$, $NH_4^+$, $NO_3^-$, $NO_2^-$, fluoride (which may be simple fluoride and/or complex fluorides such as fluozirocnate, fluosilicate, fluoborate, and the like), $SO_4^{2-}$, $Cl^-$, or the like, as optional components. The listed components represent those in general use for phosphate liquid conversion coating compositions.

Phosphate sludge, i.e., $FePO_4 \cdot n\ H_2O$, $Zn_3(PO_4)_2 \cdot nH_2O$, etc., is produced during the phosphate conversion coating of metal surfaces. Sludge-eliminating measures such as filtration and sedimentation are therefore ordinarily used since a low sludge content in the liquid conversion coating composition is desirable for forming phosphate conversion coatings.

Zn-Al alloy-plated steel sheet exhibits a better corrosion resistance and heat resistance than ordinary Zn-plated steel sheet, and as a result its applications as a corrosion-resistant material have in recent years been undergoing active development. In particular, steel sheet plated with Zn containing approximately 5% of aluminum is widely used where painting is to be executed on the steel sheet. However, when this type of steel sheet is subjected to phosphate conversion coating, aluminum ions accumulate in the treatment bath. Removal of aluminum ions from the reaction system is desired because aluminum ions are unnecessary and in fact detrimental to phosphate conversion coating.

In order to prevent Al ion accumulation in the liquid conversion coating composition, it is desirable in the conversion coating of aluminiferous metal surfaces to remove Al ions from the reaction system as a solid. For this purpose, when conversion coating at least partially aluminiferous metal surfaces, a sludge such as $NaK_2AlF_6$, $Na_3AlF_6$, etc., may also be deliberately produced, in addition to the phosphate sludge which arises spontaneously during conversion coating of any ferrous and/or zinciferous surface. For the purposes of the present specification, the term "sludge" designates a mixture of (a) solids, such as the phosphates and aluminum compounds produced by the reactions occurring during phosphate conversion coating of the metal or produced by the addition of $NaHF_2$, $KHF_2$, etc., plus (b) small amounts of metal salts not due to the aforesaid reactions, plus (c) atmospheric dust and entrained contamination adhering on the metal. This sludge is therefore typically a mixture of components such as zinc phosphate, iron phosphate, aluminum compounds such as cryolite ($Na_3AlF_6$) or elpasolite ($NaK_2AlF_6$), entrained contaminants, dust, and the like.

Japanese Patent Application Laid Open [Kokai or Unexamined] Number Sho 57-70281 [70,281/1982] discloses a phosphate conversion coating method that maintains the Al ion concentration in a zinc phosphate liquid conversion coating composition at 50 parts per million (hereinafter usually abbreviated "ppm") or less. According to this disclosure, the Al elution into a zinc phosphate liquid conversion coating composition, expressed on the basis of the unit surface area of the steel sheet, is $0.2\times10^{-3}$ to $1.0\times10^{-3}$ moles per square meter, hereinafter usually abbreviated as "mol/m$^2$". According to this method, at this quantity of elution the Al ion can be maintained at 50 ppm or less by removal of the Al as a precipitate through the continuous supply of $NaHF_2$ equimolar with the eluting Al ($=0.2\times10^{-3}$ to $1.0\times10^{-3}$ mol/m$^2$) and $KHF_2$ at twice the moles of the eluting Al ($=0.4\times10^{-3}$ to $2.0\times10^{-3}$ mol/m$^2$). The prescribed Al ion concentration is obtained in this method by the precipitative removal of Al from the reaction system as elpasolite ($NaK_2AlF_6$).

Japanese Patent Application Laid Open [Kokai or Unexamined] Number Sho 60-[204889 1204,889/1985] discloses a phosphate conversion coating method that is directed to zinc phosphate conversion coating liquid compositions whose principal ingredients are 0.85 to 1.7 grams per liter (hereinafter usually abbreviated as "g/L") of Zn ions, 1.0 to 2.5 g/L of Ni ions, 5.5 to 10 g/L of $PO_4$ ions, 0.8 to 1.5 g/L of $N0_3$ ions, 1.3 to 5.5 g/L of F ions, and small quantities of additives. In this method, $NaHF_2$ and $KHF_2$—or $NaHF_2$ and KF—are intermittently added to such liquid compositions in a quantity no more than equimolar with the quantity of Al in the liquid conversion coating composition. This results in the sedimentative removal of the Al in the zinc phosphate liquid conversion coating composition as $K_2NaAlF_6$ and provides control of the Al ions concentration in the liquid conversion coating composition to 500 ppm or less.

Removal of the aluminum ions eluted from zinc-aluminum alloy plating during phosphate conversion coating as cryolite ($Na_3AlF6$) is also known and is described in Dai-39-kai Fushoku Boshoku Toronkai Gaiyo [Title in English: Proceedings of the 39th Japan Corrosion Conference] in Fushoku Boshoku Kyokaishi [Title in English: Corrosion Engineering].

Japanese Patent Application Laid Open [Kokai or Unexamined] Number Sho 56-105485 [105,485/1981] teaches a method that facilitates sludge filtration. In this method, a polymeric coagulant is added to the conversion coating liquid composition in the phosphate conversion coating of cold-rolled steel sheet. The addition of this polymeric coagulant improves the sedimentability of the phosphate compound-containing sludge. However, this method was not investigated with regard to the sedimentation of aluminum compound-containing sludge.

The sedimentation of zinc phosphate-based sludge is facilitated by the addition of polymeric coagulant in the method taught in Japanese Patent Application Laid Open

[Kokai or Unexamined] Number Sho 56-105485 for the formation of zinc phosphate conversion coatings on steel sheet or zinc-plated steel sheet. However, there are believed to have been no previous investigations into a method that could induce the sedimentation of sludge from a liquid conversion coating composition in which aluminum compounds are present.

DESCRIPTION OF THE INVENTION

Object of the Invention—Problems To Be Solved

One object of the present invention is to solve the quality and maintenance problems during phosphate conversion coatings, by prior art methods, that are caused by aluminum compound-containing sludges, especially the problems noted above.

General Principles of Description

Except in the claims and the specific examples, or where otherwise expressly indicated, all numerical quantities in this description indicating amounts of material or conditions of reaction and/or use are to be understood as modified by the word "about" in describing the broadest scope of the invention. Practice a within the numerical limits stated is generally preferred, however. Also, unless expressly stated to the contrary: percent, "parts of", and ratio values are by weight; the term "polymer" includes "oligome", "copolymer", "terpolymer", and the like; the first definition or description of the meaning of a word, phrase, acronym, abbreviation or the like applies to all subsequent uses of the same word, phrase, acronym, abbreviation or the like and applies, mutatis mutandis, to normal grammatical variations thereof; the description of a group or class of materials as suitable or preferred for a given purpose in connection with the invention implies that mixtures of any two or more of the members of the group or class are equally suitable or preferred; specification of materials in ionic form implies the presence of sufficient counterions to produce electrical neutrality for the composition as a whole; and any counterions thus implicitly specified preferably are selected from among other constituents explicitly specified in ionic form, to the extent possible; otherwise such counterions may be freely selected, except for avoiding counterions that act adversely to the objects of the invention.

SUMMARY OF THE INVENTION

In phosphate conversion coating, the solids produced in association with the reactions and film formation as a general rule have a very small particle size when produced, but gradually aggregate and grow and become increasingly easy to filter. However, this phenomenon varies substantially as a function of the particular compounds making up the sludge. It has been found that aluminum-free phosphate sludges undergo aggregation and sedimentation relatively readily, but that the aluminum fluorides $NaK_2AlF_6$ and $NaAlF_6$ resist aggregation and enlargement. These aluminum fluorides were found to remain suspended in the phosphate conversion coating liquid composition in the small particle size form without change, thus making them refractory to filtration and sedimentation.

Aluminum compound-containing sludge at some point becomes suspended in the liquid conversion coating composition during processes that remove Al ions—which can prevent formation of the phosphate conversion coating—from the reaction system, and, since aluminum compound-containing sludge has a low sedimentability, it gradually accumulates in the liquid conversion coating composition. Aluminum compound-containing sludge is more soluble in water than other phosphate-based sludges; therefore, the former is more easily dissolved by the moisture permeating through paint films. It is believed that, when phosphating is done by use of zinc phosphating liquid composition containing substantial amounts of suspended aluminum compound-containing sludge, some of the aluminum compound-containing sludge codeposits in an intimate mixture with and/or on the surface of the depositing phosphate conversion coating and that this is the cause of the quality deteriorations in phosphate conversion coatings.

Filtration by continuous or intermittent forced passage of the liquid conversion coating composition through a suitable partially permeable barrier could be contemplated as a means for preventing the quality degradation caused by aluminum compound-containing sludge. However, the forced filtration of aluminum compound-containing sludge is quite difficult.

The invention applies to the use of a phosphate conversion coating liquid composition that contains fluoride, in addition to the essential components listed above (phosphoric acid, zinc, and water). The fluoride is desired for its good etching activity on aluminiferous surfaces, which is necessary for the production of the best quality phosphate films on aluminiferous metals. The essence of the invention is the use of at least one cationic coagulant to cause coagulation and sedimentation of sludge suspended in a fluoride-containing phosphate conversion coating liquid composition, in which at least part of the sludge includes aluminum compounds. The use of cationic polymeric coagulant according to the present invention is able to prevent quality deterioration during prolonged use of the same volume of phosphating liquid composition, by preventing substantial contact between the aluminum compound-containing sludge and the conversion coated workpiece.

DETAILED DESCRIPTION OF THE INVENTION, INCLUDING PREFERRED EMBODIMENTS

The inventors obtained the following information from experiments into a means by which polymeric coagulant(s) would be able to induce the coagulation, enlargement, and sedimentation of each sludge component present in a fluoride-containing phosphate conversion coating liquid composition.

(a) Aluminum compound-containing sludges are presumably negatively charged since they are coagulated and sedimented by cationic polymeric coagulants.

(b) The entire mixed sludge is coagulated and sedimented when a cationic polymeric coagulant is added to a liquid conversion coating composition in which a mixed sludge (aluminum compound and phosphate) is suspended. The coagulation and sedimentation of only the phosphate-based sludge does not occur.

(c) In the case of co-use of anionic polymeric coagulant and cationic polymeric coagulant, the addition of the cationic polymeric coagulant first is preferred. For example, when anionic coagulant is added first, the cationic coagulant—whose addition is necessary to induce coagulation and enlargement—is preferably added in a quantity at least as large as that of the anionic coagulant. In specific terms, when the aluminum compound-free sludge is first coagulated and sedimented using an anionic polymeric coagulant, a condition is produced in which aluminum compound-containing sludge is suspended in the liquid conversion coating composition. When the cationic polymeric coagulant is then added to liquid conversion coating composition in this state, it is preferably added in a quantity at least as large as the addition of anionic coagulant.

The method for introducing the cationic coagulant into the phosphate liquid conversion coating composition is not critical to the present invention, and any method may be used that establishes the presence of the cationic coagulant in the liquid conversion coating composition. Preferred specific methodologies are (1) replenishment with a base or secondary ingredient to which the cationic coagulant has been preliminarily added, and (2) addition of an aqueous solution prepared by dilution of the cationic coagulant in phosphate liquid conversion coating composition.

The cationic coagulant should as a general rule be used at a concentration of 1 to 100 ppm, and preferably 2 to 10 ppm. Within these ranges, the optimum concentration is more or less determined by the content and particle size of the sludge. The cationic coagulant has a reduced effect at a concentration below 1 ppm, while concentrations exceeding 100 ppm are economically undesirable.

There are no narrow limitations placed on the cationic polymeric coagulant itself, although the use of polymers with polyacrylic ester or polyacrylamide backbones and cationic, usually amine or quaternary ammonium, moieties in side groups chemically attached to the polymer backbones is preferred. The cationic polymeric coagulant may have a strong, moderate, or weak ionic strength, because all of these are effective and practical. The molecular weight of the cationic polymeric coagulant is preferably $1\times10^5$ to $2\times10^7$.

The suspended sludge concentration prior to addition of the cationic polymeric coagulant is not narrowly limited for the present invention, but as a general rule will be 100 to 10,000 ppm, assuming treatment in existing continuous conversion coating lines. The proportion of aluminum compound-containing sludge in this concentration increases with elapsed treatment time and in some cases may reach as high as 50% of the total sludge, or 5,000 ppm, based on the entire phosphating liquid composition. Either of the above-described addition methods (1) and (2) can reduce the suspended sludge concentration to 0.1 to 10 ppm within a few minutes after coagulant addition.

Nonionic coagulant or anionic coagulant may also be added on an optional basis in the execution of the present invention in order to sediment sludge other than aluminum compound-containing sludge.

The invention is explained in greater detail below using working examples, and the benefits of the invention are illustrated by comparative examples.

EXAMPLES

The test liquid conversion coating composition was prepared as follows: First, Al sheet and cold-rolled steel sheet were subjected to zinc phosphate conversion coating to give approximately 100 ppm of Al ions and approximately 2,000 ppm of phosphate sludge in the liquid conversion coating composition. After this, aluminum compound-containing sludge was produced by adding a coagulant, thus yielding the test liquid conversion coating composition. The evaluations were conducted by the methods described below.

Evaluation Methods (1) Coagulation and sedimentation performance

The polymeric coagulant (see below) was added to test liquid conversion coating composition followed by stirring for 1 minute and standing for 2 minutes. Coagulation and enlargement of the sludge and the clarity of the supernatant liquid were then inspected visually.

(2) Filtration performance

Test liquid conversion coating composition and liquid conversion coating composition after polymeric coagulant addition (see below) were filtered using nonwoven fabric with an air permeability of 100. The clarity of the filtrate was then inspected visually.

(3) Conversion performance

Aluminum sheet was treated using liquid conversion coating composition obtained by the addition of coagulant to test liquid conversion coating composition. The status of the coating was then visually inspected.

(4) Water-resistant secondary adherence

Aluminum sheet was treated with test liquid conversion coating composition and then rinsed with water and dried. This was followed by cationic electro-deposition of a base protective coating, an intermediate coating, and a top coating, in each case equivalent to automotive applications, to give the test coupon. After the test coupon had been immersed for 240 hours in deionized water at 40° C., a crosshatch pattern (2×2 mm, 100 squares) was scribed down to the aluminum sheet. An adherence test was then conducted by tape peeling.

Test liquid conversion coating composition $Zn^{2+}$: 1.5 g/L $Ni^{2+}$: 0.5 g/L $PO_4^{3-}$: 13.5 g/L fluoride : 1.0 g/L (stoichiometric equivalent as fluorine atoms)

$NO_3^-$: 6.0 g/L $NO_2^-$: 0.1 g/L $Na^{+:}$ 1.5 g/L $Na_3AlF_6$: 800 ppm (as sludge)

$FePO_4$ : 2000 ppm (as sludge)

pH : 2.9

Test polymeric coagulants (from Sanyo Chemical Industries Company, Ltd.):

| Identifier | Coagulant Trade Name | Ionicity |
|---|---|---|
| A | Sanflock ™ AM-170P | Anionic |
| N | Sanflock ™ N-500P | Nonionic |
| C1 | Sanflock ™ C-009P | Strongly cationic |
| C2 | Sanflock ™ CE-682P | Weakly cationic |

Evaluation Scales (1) Coagulation and sedimentation performance

+: the sludge was substantially coagulated and enlarged, and the supernatant had either become clear or exhibited a small residual turbidity x : the entire liquid composition lacked transparency (2) Filtration performance +: almost completely filtered x : transparency not obtained, small quantity of filtrate (3) Conversion performance +: a good quality coating was obtained x : the coating was nonuniform and uncoated areas were present (4) Water-resistant secondary adherence +: no peeled squares

* : less than 10 peeled squares x : 10 or more peeled squares

Additional test conditions and results are shown in Table 1 below. In Example 5, 4 mg/L of coagulant C2 was first added with stirring followed by the addition of 2 mg/L of coagulant A with stirring. In Example 6, 4 mg/L of coagulant C2 was first added with stirring followed by the addition of 2 mg/L of coagulant N with stirring. In Example 7, 2 mg/L of coagulant A was first added with stirring followed by the addition of 4 mg/L of coagulant C2 with stirring.

While phosphate conversion coating itself was possible in the comparative examples, poor ratings were obtained in the comparative examples for the coagulation and sedimentation performance, filtration performance, and water-resistant secondary adherence. By preventing contact between the metal treatment workpiece and most of the aluminum compound-containing sludge, the method according to the instant invention is able to prevent deterioration in the quality of phosphate conversion coatings.

TABLE 1

| Example ("Ex") or Comparison Example ("CE") Number | Coagulant | | Test Results | | | |
|---|---|---|---|---|---|---|
| | Identifier | Concentration, ppm | Coagulation and Sedimentation Performance | Filtration Performance | Conversion Performance | Water-resistant Secondary Adhesion |
| Ex 1 | C2 | 2 | + | + | + | + |
| Ex 2 | C2 | 100 | + | + | + | + |
| Ex 3 | C1 | 2 | + | + | + | + |
| Ex 4 | C1 | 100 | + | + | + | + |
| Ex 5 | C2 + A | 6 | + | + | + | + |
| Ex 6 | C2 + N | 6 | + | + | + | + |
| Ex 7 | A + C2 | 6 | + | + | + | + |
| CE 1 | none | 0 | x | x | + | x |
| CE 2 | A | 20 | x | x | + | x |
| CE 3 | N | 20 | x | x | + | x |

The invention claimed is:

1. A process for forming a phosphate conversion coating on metal surfaces that include at least some aluminiferous metal surface by contacting the metal surfaces with a volume of fluoride-containing phosphate conversion coating liquid composition for a sufficient time at a sufficient temperature to cause: (i) formation of a conversion coating on the metal surfaces and (ii) generation of insoluble dispersed solid sludge in the volume of fluoride-containing phosphate conversion coating liquid composition, said dispersed solid sludge including aluminum compounds, wherein the improvement comprises adding to the volume of fluoride-containing phosphate conversion coating liquid composition an amount of at least one cationic polymeric coagulant that is sufficient to cause coagulation and sedimentation of at least part of the aluminum compound-containing dispersed sludge.

2. A process according to claim 1, wherein the amount of cationic polymeric coagulant added to the volume of fluoride-containing phosphate conversion coating liquid composition results in a concentration from about 1 to about 100 ppm of cationic polymeric coagulant in the fluoride-containing phosphate conversion coating liquid composition.

3. A process according to claim 2, wherein the concentration of cationic polymeric coagulant in the fluoride-containing phosphate conversion coating liquid composition is from about 2 to about 10 ppm.

4. A process according to claim 3, wherein the total concentration of dispersed sludge in the fluoride-containing phosphate conversion coating liquid composition before addition of cationic polymeric coagulant is from about 100 to about 10,000 ppm.

5. A process according to claim 4, wherein the total concentration of dispersed sludge in the fluoride-containing phosphate conversion coating liquid composition within three minutes after addition of the cationic polymeric coagulant is reduced to a value in the range from about 0.1 to about 10 ppm.

6. A process according to claim 5, wherein the molecular weight of the cationic polymeric coagulant is in the range from about $1\times10^5$ to about $2\times10^7$.

7. A process according to claim 1, wherein the concentration of cationic polymeric coagulant in the fluoride-containing phosphate conversion coating liquid composition is from about 2 to about 10 ppm.

8. A process according to claim 7, wherein the total concentration of dispersed sludge in the fluoride-containing phosphate conversion coating liquid composition before addition of cationic polymeric coagulant is from about 100 to about 10,000 ppm.

9. A process according to claim 8, wherein the total concentration of dispersed sludge in the fluoride-containing phosphate conversion coating liquid composition within three minutes after addition of the cationic polymeric coagulant is reduced to a value in the range from about 0.1 to about 10 ppm.

10. A process according to claim 9, wherein the molecular weight of the cationic polymeric coagulant is in the range from about $1\times10^5$ to about $2\times10^7$.

11. A process according to claim 2, wherein the total concentration of dispersed sludge in the fluoride-containing phosphate conversion coating liquid composition before addition of cationic polymeric coagulant is from about 100 to about 10,000 ppm.

12. A process according to claim 11, wherein the total concentration of dispersed sludge in the fluoride-containing phosphate conversion coating liquid composition within three minutes after addition of the cationic polymeric coagulant is reduced to a value in the range from about 0.1 to about 10 ppm.

13. A process according to claim 12, wherein the molecular weight of the cationic polymeric coagulant is in the range from about $1\times10^5$ to about $2\times10^7$.

14. A process according to claim 1, wherein the total concentration of dispersed sludge in the fluoride-containing phosphate conversion coating liquid composition before addition of cationic polymeric coagulant is from about 100 to about 10,000 ppm.

15. A process according to claim 14, wherein the total concentration of dispersed sludge in the fluoride-containing phosphate conversion coating liquid composition within a few minutes after addition of the cationic polymeric coagulant is reduced to a value in the range from about 0.1 to about 10 ppm.

16. A process according to claim 15, wherein the molecular weight of the cationic polymeric coagulant is in the range from about $1\times10^5$ to about $2\times10^7$.

17. A process according to claim 3, wherein the total concentration of dispersed sludge in the fluoride-containing phosphate conversion coating liquid composition within three minutes after addition of the cationic polymeric coagulant is reduced to a value in the range from about 0.1 to about 10 ppm.

18. A process according to claim 17, wherein the molecular weight of the cationic polymeric coagulant is in the range from about $1\times10^5$ to about $2\times10^7$.

19. A process according to claim 2, wherein the total concentration of dispersed sludge in the fluoride-containing phosphate conversion coating liquid composition within three minutes after addition of the cationic polymeric coagulant is reduced to a value in the range from about 0.1 to about 10 ppm.

20. A process according to claim 19, wherein the molecular weight of the cationic polymeric coagulant is in the range from about $1\times10^5$ to about $2\times10^7$.

* * * * *